United States Patent [19]

Kubota et al.

[11] 4,175,653

[45] Nov. 27, 1979

[54] MAN CONVEYOR

[75] Inventors: Masayuki Kubota, Nakaminato; Masamitu Hanano, Katsuta, both of Japan

[73] Assignee: Hitachi, Ltd., Japan

[21] Appl. No.: 844,990

[22] Filed: Oct. 25, 1977

[30] Foreign Application Priority Data

Oct. 29, 1976 [JP] Japan ..... 51-129467

[51] Int. Cl.[2] ..... B66B 9/14

[52] U.S. Cl. ..... 198/332; 198/335

[58] Field of Search ..... 198/321, 326, 330, 332, 198/335, 337, 338

[56] References Cited

U.S. PATENT DOCUMENTS

| | | | |
|---|---|---|---|
| 951,744 | 3/1910 | Seeberger | 198/326 |
| 1,025,316 | 5/1912 | Seeberger | 198/330 |
| 2,686,585 | 8/1954 | Margles et al. | 198/332 |

FOREIGN PATENT DOCUMENTS

| | | | |
|---|---|---|---|
| 1274286 | 8/1968 | Fed. Rep. of Germany | 198/338 |
| 2548651 | 5/1976 | Fed. Rep. of Germany | 198/335 |
| 2640188 | 3/1977 | Fed. Rep. of Germany | 198/326 |
| 6612032 | 10/1967 | Netherlands | 198/321 |

*Primary Examiner*—James L. Rowland

*Attorney, Agent, or Firm*—Craig and Antonelli

[57] ABSTRACT

In a man conveyor, a framework includes, as main frame members, beams of a steel material in the form of a letter I or of other shape in cross section, and struts for supporting guide members for endless handrails are rigidly secured to upper edge portions of the beams. The framework of this man conveyor is highly solid and makes possible simplification of the internal structure of the man conveyor.

6 Claims, 4 Drawing Figures

MAN CONVEYOR

LIST OF PRIOR ART REFERENCES (37 CFR 1.56 (a))

The following references are cited to show the state of the art:

Prior U.S. Application:

U.S. Ser. No. 718,010 filed on Aug. 26, 1976.

Prior Publication:

U.S. Pat. No. 2,039,994 K. H. W. Herker May 5, 1936 (Cl. 198-331).

This invention relates to a man conveyor, such as an escalator, which has a framework including framed structures of a construction adapted to support thereon guide members for handrails.

Generally, in an escalator which is a typical man conveyor, a plurality of steps linked in an endless belt arranged between a pair of balustrades are driven by upper drive means and lower drive means to move on guide rails for their trip from a passenger boarding area of the escalator to a passenger alighting area thereof and on separate guide rails for their trip from the passenger alighting area to the passenger boarding area. A pair of handrails are each guided by a guide member on one of the balustrades in their trip from the passenger boarding area to the passenger alighting area and by a plurality of guide rollers in their trip from the passenger alighting area to the passenger boarding area, so that the endless handrails move in the same direction and at the same speed as the plurality of endless steps.

An escalator of this type of the prior art comprises a framework of a truss type and includes a framed structure located in each of the balustrades and having an upper main member, a lower main member and auxiliary members for supporting the upper and lower main members in vertically spaced parallel relation. Rail support girders for interconnecting the auxiliary members on both sides of the plurality of steps and projecting rail support blocks are rigidly secured to the auxiliary members of the framed structures. The guide rails for the plurality of endless steps in their trip from the passenger boarding area to the passenger alighting area are supported by the rail support girders, while the guide rails for the plurality of endless steps in their trip from the passenger alighting area to the passenger boarding area are supported by the rail support blocks.

The plurality of guide rollers for the handrails are mounted on guide roller support blocks rigidly secured to the auxiliary members of the framed structures for guiding the movement of the handrails during their trip from the passenger alighting area to the passenger boarding area. The lower main members of the framed structures on both sides of the endless steps are connected together and fixed by connecting members which have secured thereto an oil receiver for receiving lubricating oil for chains of the steps and the rails and dust etc. carried by passengers.

The framework of the aforementioned construction of an escalator of the prior art consists of framed structures each of which is of a truss type and comprises an upper main member, a lower main member and auxiliary members joined by welding. Stated differently, each framed structure consists of independent members, and the number of these members is very large. Moreover, the auxiliary members generally differ from one another in length depending on the positions in which they are located, such as upper or lower area, horizontal passenger boarding and alighting areas and an intermediate inclined area of the escalator, and the forces exerted on the auxiliary members differ greatly from those exerted on the main members. Therefore, the framework of the escalator of the prior art has some disadvantages. Members of different lengths and different types are required for each framed structure of the truss type and the framed structure itself becomes complex in construction. Inasmuch as independent members are joined by welding to constitute each framed structure, it is essential to eliminate errors in assembling and dimensions of the framed structures. Thus it requires a lot of labor and time to select suitable members, handle the selected members and assemble the same. Also, the support girders and the support blocks are all independent members and joined to the auxiliary members by welding. Thus, they also have the same disadvantages as are referred to hereinabove.

The framework of an escalator is required to have sufficiently high strength to support the heavy weight of the load of passengers, steps, handrails, balustrades including guide members for the handrails, and exterior decorations. Also, it is necessary to minimize the total depth and total width of an escalator in order that no more space than is necessary will be occupied by the escalator in a building in which it is installed. In order to minimize the total depth and total width of the escalator and yet to impart to the framework sufficiently high strength to support the aforesaid heavy weight, it is necessary to minimize the clearance between the endless steps and the oil receiver, to increase the spacing between the upper and lower main members, and to increase the rigidity of the truss structures as a whole. Accordingly, the handrails are disposed inwardly of the upper main members or auxiliary members during their trip from the passenger alighting area to the passenger boarding area. Also, since it is necessary to reduce the overall width of the escalator as aforementioned, it is not possible to provide an upper surface of a large area to each of the upper main members, with the result that it is impossible to secure in a stable manner to the upper main members struts for supporting the guide members for the handrails. This makes it necessary to secure a reinforcing member of a large area widthwise of the escalator to the inner side of each upper main member so as to hold in place the handrail guide member supporting struts by utilizing a surface of a large width made up of surfaces of each upper main member and each reinforcing member, so that it is possible to bear a load applied to the handrail guide member supporting struts in a direction crosswise of the escalator when one of the handrails is pushed by passengers. The use of the reinforcing members referred to hereinabove has a disadvantage in that the positions in which they are secured and their shapes should be varied depending on the style of the escalator or whether the handrail guide members are supported by the struts or by glass panes without using struts.

In regard to the handrail guide rollers, it is necessary that such rollers not only support the handrails but also permit the handrails to move smoothly without moving in zigzag movement. In the escalator of the prior art referred to above, however, the guide rails are mounted in a narrow space inwardly of each framed structure. Thus, there are disadvantages in that difficulties are encountered in mounting the guide rollers accurately and hence a smooth movement of the handrails is prevented.

The description set forth hereinabove has been confined to an escalator as a typical man conveyor. However, other types of man conveyor, such as electrically operated passengeway, also have the aforementioned disadvantages.

As another example of the prior art, U.S. Pat. No. 2,039,994 may be cited as a reference. In this patent, a framed structure includes a carrier beam extending longitudinally of an escalator on either side thereof and supporting uprights which mount rails for the steps.

Some disadvantages are also associated with this construction. Each beam would independently be subjected to torsional deformation, and when the load of passengers is lop-sided, the load would be supported by the beam of one side. Since each beam has a very small height, the formed structure lacks torsional rigidity, and it would be impossible to bear the total load of the escalator as a whole by the beams of a small size which are used in this patent.

This invention has as its object the provision of a man conveyor which obviates the aforementioned disadvantages of the prior art, and which is simple in construction and yet high in strength.

The outstanding characteristic of the invention is that the aforementioned object is accomplished by using a framework including beams of a steel material in the form of a letter I or having other shape, and each of such beams has rigidly secured to its upper edge portion struts for supporting a guide member for an endless handrail.

Figure 1:
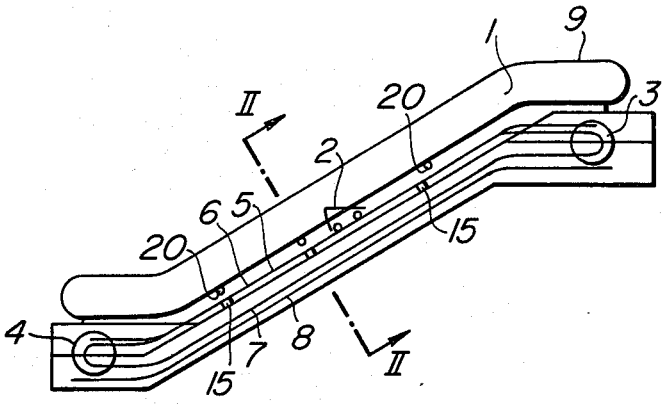
FIG. 1 is a schematic side view of an escalator comprising one embodiment of the invention.

The construction of an escalator in which the present invention can have application will be outlined by referring to FIG. 1. As shown, a plurality of steps 2 linked in an endless belt are located between a pair of balustrades 1 (only one is shown) and driven for movement by upper drive means 3 and lower drive means 4. In their travel from a passenger boarding area of the escalator to a passenger alighting area thereof, the endless steps 2 are guided to move along guide rails 5 and 6, while in their travel from the passenger alighting area to the passenger boarding area, they are guided to move along guide rails 7 and 8. A pair of endless handrails 9 (only one is shown) are each guided by one of the balustrades 1 in their travel from the passenger boarding area to the passenger alighting area, and by plurality of guide rollers 20 in their travel from the passenger alighting area to the passenger boarding area. The pair of endless handrails 9 move in the same direction and at the same speed as the endless steps 2.

A framed structure comprising essential parts of the invention will be described by referring to FIG. 2 which is a fragmentary enlarged sectional view on the line II—II of FIG. 1. Since the escalator having framed structures located in the balustrades 1 on both sides of the endless steps 2 are symmetrical, only a right half portion thereof is shown and a left half portion thereof is omitted.

Figure 2:
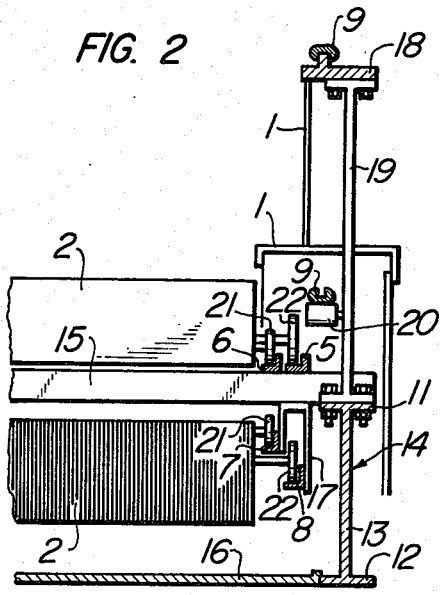
FIG. 2 is a sectional view, on an enlarged scale, taken along the line FIG. II—II in FIG. 1.

In FIG. 2, there is provided in the balustrade 1 a main frame member 14 consisting of an upper edge portion 11, a lower edge portion 12, and a vertical portion 13 interposed between the upper and lower edge portions 11 and 12 for interconnecting the same. The main frame member 14 is in the form of a beam made of a steel material of a shape of a letter I, for example. Cross girders 15 are rigidly secured at opposite ends thereof to the upper edge portions 11, 11 of the main frame members 14, 14 located on both sides of the endless steps 2, while a connecting member or oil receiver 16 serving concurrently as a reinforcing member is secured at opposite ends thereof to the lower edge portions 12, 12 of the main frame members 14, 14. These parts constitute a framework of a box shape. Each of the cross girders 15 has secured to its upper surface the guide rails 5 and 6 for guiding the endless steps 2 in their travel from the passenger boarding area to the passenger alighting area, and has secured to its underside a support frame 17 mounting thereon the guide rails 7 and 8 for guiding the endless steps 2 in their travel from the passenger alighting area to the passenger boarding area. Each main frame member 14 has secured to its upper edge portion 11 struts 19 for supporting a guide member 18 for guiding one of the pair of endless handrails 9. The struts 19 each have secured thereto a guide roller 20 for guiding the handrail 9 in its travel from the passenger alighting area to the passenger boarding area. Thus a framed structure is provided in each of the balustrades 1. Each step 2 has secured to each side thereof step support wheels 21 and 22 which move in rolling movement along the guide rails 5 and 6 and the guide rails 7 and 8, respectively when the steps 2 move in opposite directions. Each handrail 9 moves on the guide member 18 and the guide rollers 20 in its movement in opposite directions.

In the embodiment shown and described hereinabove, the escalator comprises a framework including a pair of main frame members 14, 14 of a beam type made of a steel material of a shape of letter I in cross section, a plurality of cross girders 15, 15 rigidly secured to upper edge portions 11, 11 of the main frame members 14, 14, and an oil receiver 16 serving concurrently as a reinforcing member connected to lower edge portions 12, 12 of the main frame members 14, 14. The framework differs from the framework of an escalator of the prior art which comprises a plurality of independent unitary members assembled into a truss. Since each main frame member 14 is in the form of a beam consisting of a single member, the framework of the escalator according to the invention is simple in construction and easy to assemble. The framework is of a box shape in which the main frame members 14, 14 on opposite sides of the endless steps are rigidly connected at their upper edge portions 11, 11 by the cross girders 15, 15 and at their lower edge portions 12, 12 by the oil receiver 16. Because of this arrangement, the main frame has high solidity. In addition to simplification of the main frame, it is only the cross girders 15, 15 to which the guide rails 5, 6 and 7, 8 are secured and the upper edge portions 11, 11 of the main frame member 14, 14 to which are secured the struts 19, 19 for supporting the guide rails 20, 20 and the handrails 18, 18, that are required to have a dimensional accuracy when the main frame members are assembled. Thus, assembling of the parts and adjusting of the dimensions are facilitated. Since each of the main frame members 14, 14 is in the form of a beam and consists of one member, the rigidity of the main frame members is increased and the spacing between each upper edge portion 11 and each lower edge portion 12 of each main frame member 14 can be reduced as compared with the corresponding spacing in the framework of the truss type of the prior art. Consequently, each handrail 9 in its travel from the passenger alighting area to the passenger boarding area can be placed in a position higher than each upper edge portion 11 of each main frame member 14, and the struts 19, 19 can be positively held in place even if high forces are exerted thereon when passengers on the steps 7 lean heavily against the guide members 18, 18 for the handrails 9, 9.

In the framework of the prior art, each framed structure on either side of the endless steps is constructed such that it is necessary to machine each main frame member for rigidly securing thereto struts 19 for supporting each guide member 18 for each handrail 9. In the framework according to the invention, each main frame member has an upper surface of a sufficiently large area to secure the struts directly thereto, thereby greatly increasing operational efficiency. Also, the guide rollers 20, 20 for guiding the handrails 9 in their travel from the passenger alighting area to the passenger boarding area are each mounted on one side of each strut 19. This arrangement offers advantages in that mounting of the guide rollers is facilitated and adjusting of dimensions are also facilitated, thereby enabling the handrails 9 to move smoothly.

Figure 3:
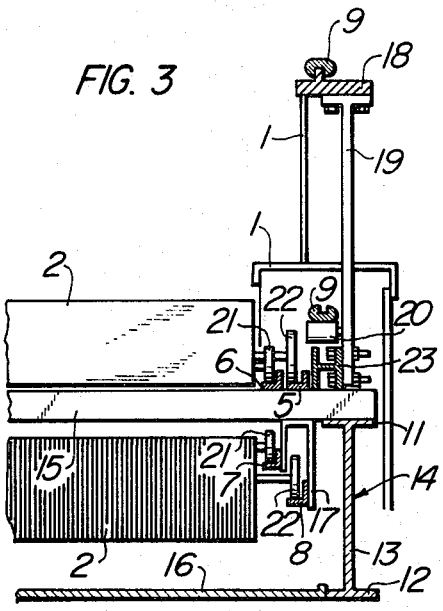
FIG. 3 and FIG. 4 show other embodiments of the invention in enlarged sectional views taken along the line II—II in FIG. 1.
Figure 4:
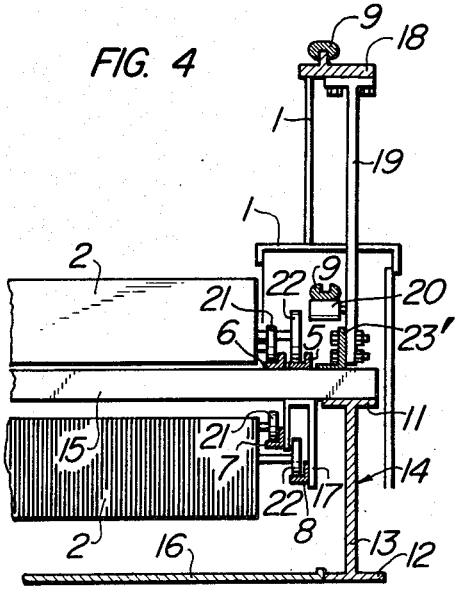

FIG. 3 shows another embodiment of the present invention in an enlarged sectional view taken along the line II—II of FIG. 1. In this figure, parts similar to those shown in FIG. 2 are designated by like reference characters. The embodiment shown in FIG. 3 is substantially similar to the embodiment shown in FIG. 2 except for the fact that intermediate members 23 are secured to the cross girders which in turn are secured to the upper edge portion 11 of each main frame member 14 of the I shape by means of welding or the like so that each intermediate member 23 has secured thereto one of the struts 19. Besides the advantages offered by the embodiment shown in FIG. 2, the embodiment shown in FIG. 3 offers an advantage in that, even if the positions of the struts 19 are altered due to a change in the designed pattern of the balustrades, the main frame members 14, 14 of the I shape can be used by merely changing the intermediate members 23. This not only contributes to improve productivity but also minimizes errors in production due to an alteration in the designed pattern. In the embodiment shown and described hereinabove, a steel material of the I shape in cross section has been used as one of the main frame members 14, 14, but it is to be understood that a steel material in the form of a sideways letter U in cross section may be used with the steel material facing either inwardly or outwardly. It is also to be understood that the intermediate members 23, 23 for supporting the struts 19, 19 may each be modified to the L-shaped intermediate members 23', 23' as shown in FIG. 4 or I-shaped members without causing any change in the results achieved by the invention.

In the man conveyor according to the invention, the main framework itself is rendered very solid and makes it possible to simplify the internal structure of the man conveyor. Moreover, mounting and adjusting of dimensions of the struts for supporting the handrail guide rollers are the handrail guide members are facilitated. Thus the invention can markedly increase the speed at which a man conveyor, such as an escalator, is installed.

We claim:

1. A man conveyor comprising:

a plurality of steps linked in an endless belt and each having front and rear wheels mounted on both lateral sides thereof;

a plurality of balustrades located on both sides of said plurality of steps in an adjacent relationship thereto;

a pair of guide members each mounted on one of said pair of balustrades, each said guide members having an upper end of said balustrade connected to the underside thereof in a position above and laterally near said plurality of steps;

a pair of endless handrails each guided by one of said pair of guide members for movement in the same direction and the same speed as said plurality of steps;

a pair of main frame members each in the form of an I-beam located on either side of said plurality of steps, each of said pair of main frame members being disposed below one of said pair of balustrades as an entity separate from said balustrade and consisting of a horizontal upper edge portion including a horizontal surface, a horizontal lower edge portion including a horizontal surface and a vertical portion interposed between said upper and lower horizontal edge portions and formed integrally therewith;

upper and lower connecting members interconnecting said upper horizontal edge portions of said plurality of main frame members on both sides of the plurality of steps and said lower horizontal edge portions thereof respectively, said upper and lower connecting members and said plurality of main frame members being arranged in a manner to form a box-shaped cross section;

a plurality of guide rails mounted on upper and lower surfaces of said upper connecting members for guiding said front and rear wheels of said plurality of steps during the travel of said steps between a passenger boarding area and a passenger alighting area of the main conveyor in both normal and reverse directions; and a plurality of struts each rigidly secured at an upper end thereof to the underside of one of said pair of guide members in a position laterally spaced from the position in which one of said pair of balustrades is connected to said guide member and secured at a lower end thereof to the horizontal upper edge portion of each said main frame members upon said horizontal surface.

2. A man conveyor as set forth in claim 1, wherein each of said struts is secured to the upper edge portion of each main frame member through said connecting members.

3. A man conveyor as set forth in claim 1, wherein each of said struts mounts a guide roller for guiding each of said handrails in its travel from a passenger alighting area of the man conveyor to a passenger boarding area thereof.

4. A man conveyor as set forth in claim 1, wherein each of said struts is secured to the upper edge portion of each main frame member through an intermediate member.

5. A man conveyor as set forth in claim 4, wherein said intermediate member is in the form of a letter I or L in cross section.

6. A man conveyor according to claim 1, wherein the underside of each guide member is planar and wherein a handrail receiving guide is provided on an upperside thereof, wherein each of said struts has a T-shaped upper end which is connected to one said underside at a position laterally to one side of the receiving guide, and wherein each of said balustrades is connected to said underside at a position laterally to an opposite side of the receiving guide from said strut.

* * * * *